US005982104A

United States Patent [19]

Sasaki et al.

[11] Patent Number: 5,982,104

[45] **Date of Patent: *Nov. 9, 1999**

[54] DRIVER FOR CAPACITIVE LIGHT-EMITTING DEVICE WITH DEGRADATION COMPENSATED BRIGHTNESS CONTROL

[75] Inventors: Yoshio Sasaki, Kawagoe; Mamoru Saitoh, Yonezawa, both of Japan

[73] Assignees: Pioneer Electronic Corporation; Tohoku Pioneer Electric Corporation, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,479

[22] Filed: Nov. 22, 1996

[30] Foreign Application Priority Data

Dec. 26, 1995 [JP] Japan ..... 7-339122

[51] Int. Cl.[6] ..... H05B 37/02

[52] U.S. Cl. ..... 315/169.3; 315/209 R; 315/307; 315/DIG. 7

[58] Field of Search ..... 315/209 R, 307, 315/DIG. 7, 169.3

[56] References Cited

U.S. PATENT DOCUMENTS 5,559,402 9/1996 Corrigan, III ..... 315/169.3

5,736,973 4/1998 Godfrey et al. ..... 315/169.3

FOREIGN PATENT DOCUMENTS 0 278 253 A1 8/1988 European Pat. Off. .

*Primary Examiner*—Michael B Shingleton

*Attorney, Agent, or Firm*—Morgan, Lewis & Bockius LLP

[57] ABSTRACT

A driving apparatus according to the invention turns on a capacitive light emitting device having a first electrode and a second electrode in accordance with a light-on instruction. The apparatus has: a voltage accumulating unit, for example, a capacitor for holding a voltage energy corresponding to the contents of the light-on instruction; a circuit for applying the voltage energy held in the voltage accumulating unit to a portion across electrodes (A and B) in one direction in response to a first control signal and for applying the voltage energy held in the voltage accumulating unit to the portion across the electrodes in the other direction in response to a second control signal; and a circuit for alternately generating the first and second control signals. The invention can cope with a deterioration due to an aging change or the like, prevent a reduction of a light emission intensity due to the deterioration or the like, and contribute to a simplification of the construction and a decrease in costs.

12 Claims, 6 Drawing Sheets

DRIVER FOR CAPACITIVE LIGHT-EMITTING DEVICE WITH DEGRADATION COMPENSATED BRIGHTNESS CONTROL

BACKGROUND OF THE INVENTION

1. Field of the Invention

The present invention relates to driving method and apparatus in a display or light emitting system and, more particularly, to method and apparatus for driving a capacitive light emitting device such as an electroluminescence device (hereinafter, called an EL device) or the like.

2. Description of the Related Art

One technique has been known, in which a capacitive light emitting device, for example, an EL device is driven by using an alternating-current voltage source. According to the technique, by alternately applying constant voltages having forward/reverse polarities across electrodes of the device, the device is allowed to emit a light.

A light emission luminance or intensity of the capacitive light emitting device, however, is reduced due to a deterioration by an aging change or time-varying. A countermeasure for this is consequently desired.

In a light-emitting system, display system, or optical system having the device of this kind, what is called a good yield is requested. That is, a simplification of the structure and a reduction in costs have to be also considered.

SUMMARY OF THE INVENTION

It is, therefore, an object of the invention to provide method and apparatus for driving a capacitive light emitting device, in which they can cope with a deterioration by an aging change or the like.

It is another object of the invention to provide method and apparatus for driving a capacitive light emitting device, in which they can prevent a reduction in light emission intensity due to a deterioration by an aging change or the like.

It is further another object of the invention to provide method and apparatus for driving a capacitive light emitting device, in which they can achieve the above objects with a simple structure and contribute to a decrease in costs.

According to one aspect of the invention, there is provided a driving method of turning on a capacitive light emitting device having a first electrode and a second electrode in accordance with a light-on instruction, comprising: a first step of holding a voltage energy corresponding to the contents of the light-on instruction by voltage accumulating means; and a second step of supplying the voltage energy held by the voltage accumulating means to a portion across the first and second electrodes while alternately inverting polarities of the voltage energy.

According to another aspect of the invention, there is provided a driving apparatus for turning on a capacitive light emitting device having a first electrode and a second electrode in accordance with a light-on instruction, comprising: voltage accumulating means for holding a voltage energy corresponding to the contents of the light-on instruction; applying means for applying the voltage energy held in the voltage accumulating means to a portion across the first and second electrodes in one direction in response to a first control signal and for applying the voltage energy held in the voltage accumulating means to the portion across the first and second electrodes in the other direction in response to a second control signal; and control means for alternately generating the first and second control signals.

According to the solving steps or means, since the voltage applied to the capacitive light emitting device rises in accordance with a decrease in equivalent capacitance of the capacitive light emitting device, a deterioration in drive efficiency of the capacitive light emitting device for the applied voltage is compensated.

DETAILED DESCRIPTION OF THE PREFERRED EMBODIMENT

An embodiment of the invention will now be described hereinbelow with reference to the drawings.

Figure 1:
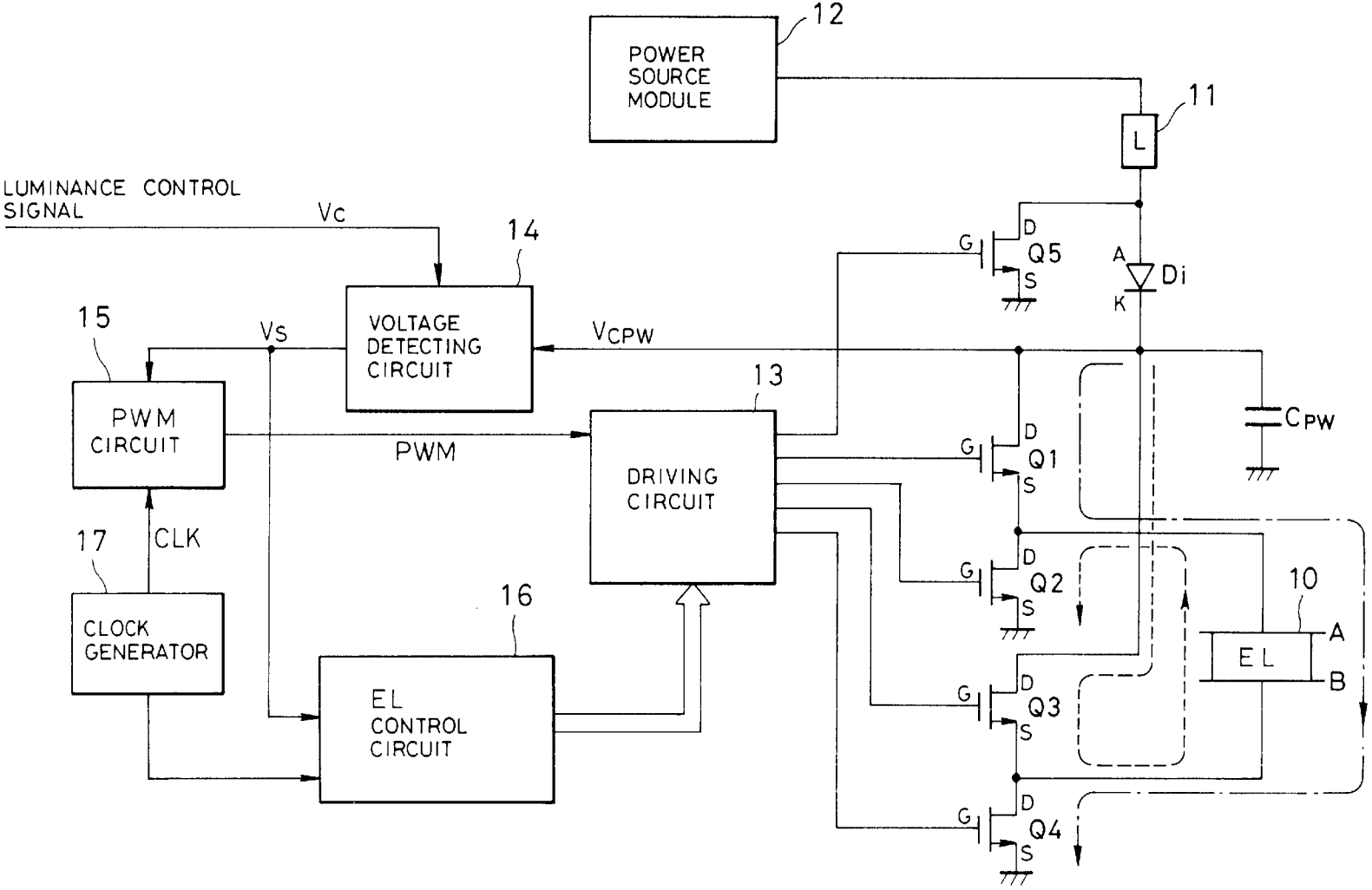
FIG. 1 is a block diagram showing a structure of a display system to which a driving method according to the invention is applied.

FIG. 1 shows an embodiment of a display system to which a driving method according to the invention is applied.

In FIG. 1, an EL device 10 as a capacitive light emitting device functions as, for example, a so-called illumination which is used in a display or an operation panel each of a car stereo set or the like. The EL device 10 is connected to a common connecting point of MOS transistors Q1 and Q2 and connected a common connecting point of MOS transistors Q3 and Q4. In more detail, one electrode A of the EL device 10 is connected to the connecting point between a source of the transistor Q1 and a drain of the transistor Q2. Another electrode B is connected to the connecting point between a source of the transistor Q3 and a drain of the transistor Q4. A voltage generated by a power source module 12 including a regulator is supplied to each of drains of the transistors Q1 and Q3 via an inductance element or inductance circuit 11 and a diode Di. A drain of an MOS transistor Q5 is connected to a connecting point between the inductance element 11 and diode Di. In the transistor Q5, a source is connected to the ground and a control signal from a driving circuit 13 is supplied to a gate. The driving circuit 13 individually supplies control signals to not only the gate of the transistor Q5 but also gates of the transistors Q1 to Q4.

As one feature of the embodiment, one end of a capacitor Cpw is connected to a cathode of the diode Di. Another end of the capacitor Cpw is connected to the ground. The one end of the capacitor Cpw is led to a voltage detecting circuit 14 as a signal line for monitoring charging and discharging states of the capacitor. The transistors Q1 to Q4 function as bidirectional conductive switches for relaying the voltage energy held in the capacitor Cpw as voltage accumulating means across the electrodes A and B while alternately inverting the polarities.

In addition to a voltage Vcpw across the capacitor, Cpw through the signal line, a luminance control signal Vc serving as a light-on instruction from a system control circuit (not shown) is supplied to the voltage detecting circuit 14. On the basis of the voltage and signal, the voltage detecting circuit 14 generates a control signal Vs to a PWM (Pulse Width Modulation) circuit 15 and an EL control circuit 16. A reference clock signal CLK at a predetermined frequency, which is generated by a clock generator 17, is also supplied to the PWM circuit 15. The PWM circuit 15 forms a PWM signal to control the transistor Q5 on the basis of the clock signal CLK and control signal Vs and supplies the PWM signal to the driving circuit 13. The EL control circuit 16 supplies signals to control the transistors Q1 to Q4 to the driving circuit 13 on the basis of the control signal Vs from the voltage detecting circuit 14 and the clock signal from the clock generator 17.

The driving circuit 13 supplies a gate control signal having a voltage or a current adapted to the gate of each transistor on the basis of the PWM signal from the PWM circuit 15 and the Q1 to Q4 control signals from the EL control circuit 16.

The operation of the display system will now be described.

Figure 2:
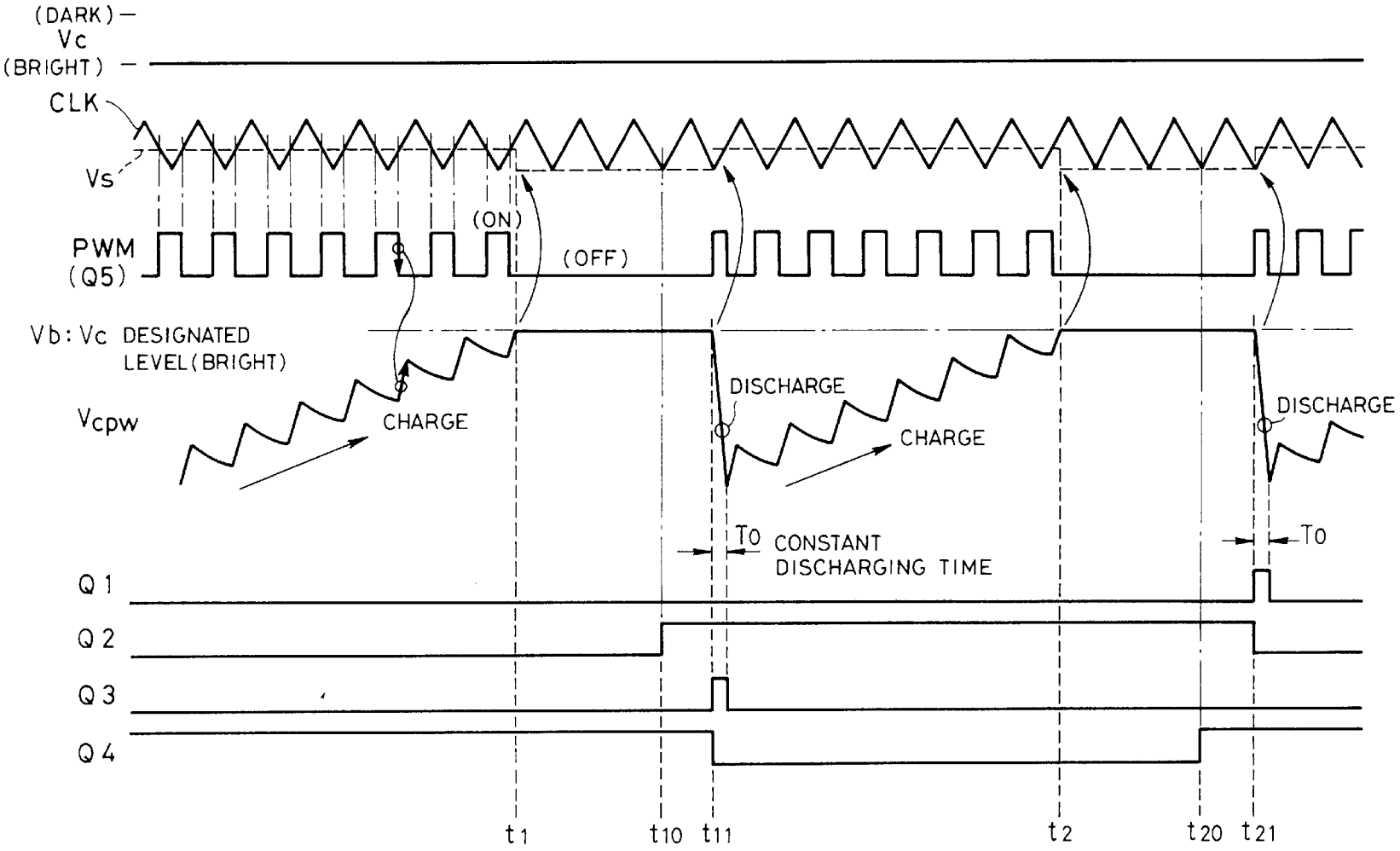
FIG. 2 is a time chart showing operation waveforms in respective portions when a luminance control in the display system of FIG. 1 is fixed.

FIG. 2 is a time chart showing operation waveforms of respective sections in FIG. 1. The reference characters and signal names used in FIG. 1 are used for corresponding waveforms.

In FIG. 2, the luminance control signal Vc keeps a level (low level) for designating the EL device 10 to a high luminance, namely, bright state. In this case, the voltage detecting circuit 14 sets the control signal Vs to the high level until the voltage Vcpw of the capacitor Cpw reaches the high level corresponding to the low level of the luminance control signal Vc. On the contrary, the voltage detecting circuit 14 sets the control signal Vs to the low level after the voltage Vcpw of the capacitor Cpw reached the high level corresponding to the low level of the luminance control signal Vc.

The PWM circuit 15 sets the PWM signal to the low level when the level of the pulsating triangular wave clock signal CLK from the clock generator 17 is higher than the level indicated by the control signal Vs. Contrarily, the PWM circuit 15 sets the PWM signal to the high level when the level of the clock signal CLK is lower than the level indicated by the control signal Vs. The high level indicated by the control signal Vs falls short of the median of the clock signal CLK and the low level indicated by the control signal Vs falls short of the minimum value of the clock signal CLK. Consequently, the PWM signal shows a rectangular wave for a period of time during which the control signal Vs is at the high level and maintains the low level for a period of time during which the control signal Vs is at the low level.

The PWM signal controls the transistor Q5 via the driving circuit 13. That is, the driving circuit 13 generates a gate control signal to turn on the transistor Q5 in response to the high level of the PWM signal and generates a gate control signal to turn off the transistor Q5 in response to the low level of the PWM signal. The capacitor Cpw is charged in accordance with the on/off operations of the transistor Q5. In more detail, when the transistor Q5 is in an ON state, a current from the power source module 12 mainly flows via the inductance element 11 and transistor Q5. When the transistor Q5 is in an OFF state, a high-voltage energy generated due to a counterelectromotive force mainly by the energy accumulated in the inductance element 11 flows into the capacitor Cpw through the diode Di. Therefore, in a transition from the ON state to the OFF state of the transistor Q5, the capacitor Cpw is charged. When the transistor Q5 is in the OFF state, the charged voltage is substantially held. A momentary rapid or abrupt increase of Vcpw in the transition from OFF to ON of the transistor Q5 and a descent from the increased level (refer to FIG. 2) can be regarded as a transient phenomenon.

As shown in FIG. 2, since the voltage Vcpw reaches the high level Vb corresponding to the low level (bright state of the EL device) of the luminance control signal Vc at time t1 or t2, the PWM signal maintains the low level in cooperation with the voltage detecting circuit 14 and PWM circuit 15. The charging operation of the capacitor Cpw is then stopped for a while and the Vb level is held.

At time t1, the EL control circuit 16 detects based on a trailing edge of the control signal Vs from the voltage detecting circuit 14, that the voltage Vcpw has reached Vb. The EL control circuit 16 supplies a control signal to turn on the transistor Q2, for example, (0101) of four bits to the driving circuit 13 after the elapse of a first predetermined time from the detection time point (time t10) and supplies a control signal to turn on the transistor Q3 and to turn off the transistor Q4, for example, (1010) to the driving circuit 13 after the elapse of a second predetermined time (time t11). These control signals for the transistors to apply the voltage energy of the capacitor Cpw to the EL device 10 in the direction (B→A) corresponds to a first control signal. At time t11, consequently, the transistors Q1, Q2, Q3, and Q4 are turned off, on, on, and off, respectively. The capacitor Cpw is discharged and the charged voltage so far is applied to an electrode B of the EL device 10 via the transistor Q3. That is, the voltage of the polarity (B→A direction) as drawn by a broken line in FIG. 1 is applied to the EL device 10. The discharge of the capacitor Cpw is performed in the ON state of the transistor Q3. The EL control circuit 16 stops the control signal to turn on the transistor Q3 after the elapse of a predetermined discharging time T0 from the start (time t11) of the discharge of the capacitor Cpw. When the transistor Q3 is consequently turned off, the voltage cannot be applied to the EL device 10 via the transistor Q3. Since the voltage Vcpw drops lower than the Vb level due to the discharge of the capacitor Cpw, the voltage detecting circuit 14 resets the control signal Vs to the high level. The PWM signal, therefore, again shows a rectangular wave and the charging operation of the capacitor Cpw is restarted.

At time t2 as well, the EL control circuit 16 detects that the voltage Vcpw has reached Vb by the trailing edge of the control signal Vs from the voltage detecting circuit 14. After the elapse of the first predetermined time from the detection time point, the EL control circuit 16 subsequently supplies a control signal to turn on the transistor Q4, for example, (0001) to the driving circuit 13 (time t20). After the elapse of the second predetermined time from the detection time point, the EL control circuit 16 supplies a control signal to turn on the transistor Q1 and to turn off the transistor Q2, for example, (1000) to the driving circuit 13 (at time t21). These control signals for the transistors to apply the voltage energy of the capacitor Cpw to the EL device 10 in the (A→B) direction corresponds to the second control signal. The transistors Q1, Q2, Q3, and Q4 are, therefore, turned on, off, off, and on, respectively, at time t21. The capacitor Cpw is discharged and the charged voltage so far is applied to an electrode A of the EL device 10 through the transistor Q1. That is, the voltage having the polarity (A→B direction) as shown by the alternate long and short dash line in FIG. 1 is applied to the EL device 10. The discharge of the capacitor Cpw is executed in the ON state of the transistor Q1. The EL control circuit 16 stops the control signal to turn on the transistor Q1 after the elapse of the predetermined discharging time T0 since the start (time t21) of the discharge of the capacitor Cpw. When the transistor Q1 is consequently turned off, the voltage cannot be applied to the EL device 10 via the transistor Q1. Since the voltage Vcpw drops lower than the Vb level by the discharge of the capacitor Cpw, the voltage detecting circuit 14 resets the control signal Vs to the high level. The PWM signal, therefore, again shows a rectangular wave and the charging operation of the capacitor Cpw is restarted.

The capacitor Cpw is, consequently, discharged for the predetermined time T0 each time it is charged to the Vb level. The discharge voltage of the capacitor is alternately applied to the EL device 10 in the (B→A) direction as shown at time t11 and in the (A→B) direction as shown at time t21.

Figure 3:
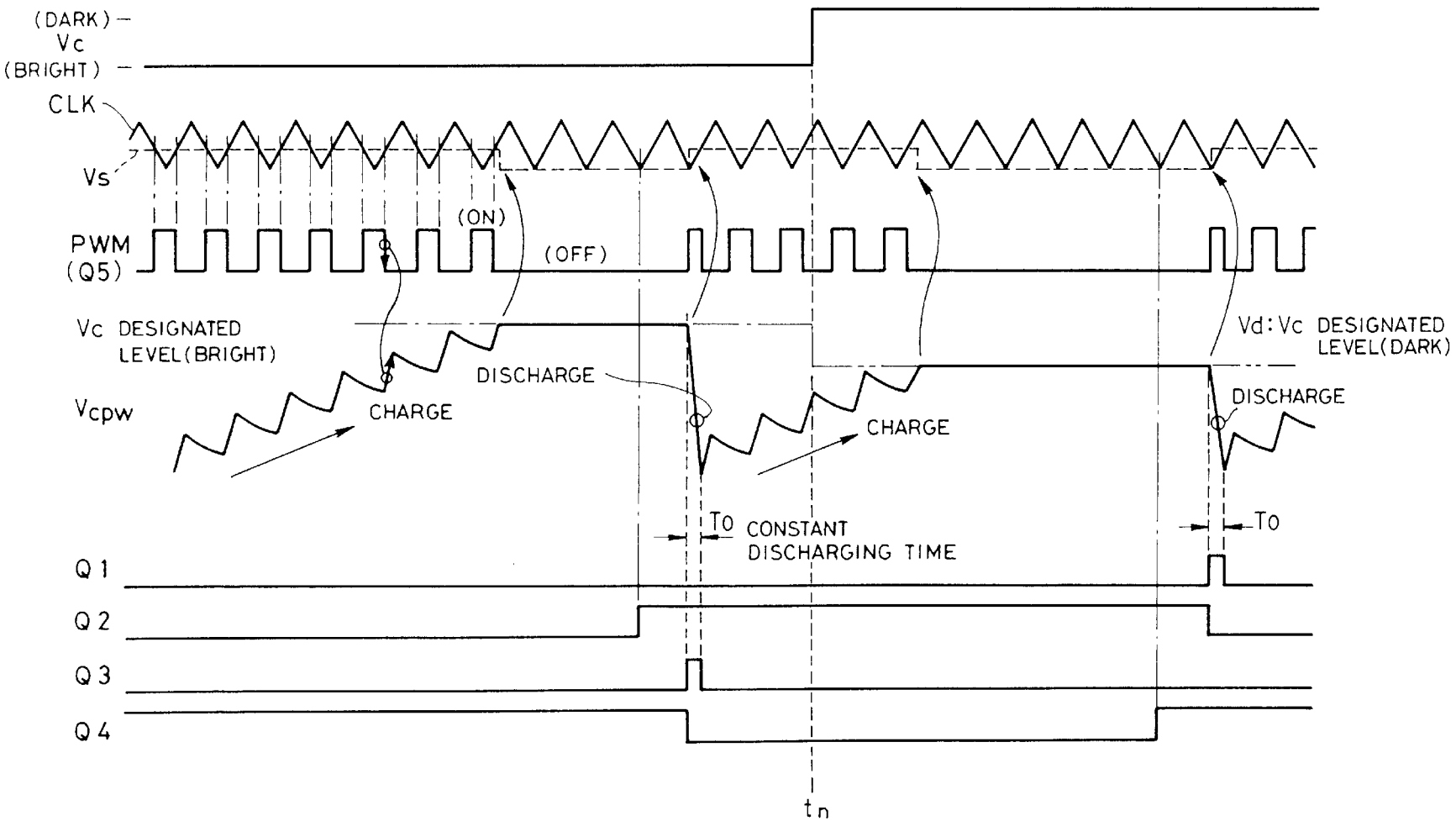
FIG. 3 is a time chart showing operation waveforms in respective portions when the luminance control in the display system of FIG. 1 is switched.

FIG. 2 shows a case where the luminance control signal Vc maintains a fixed level (level corresponding to the bright state of the EL device) and the system operates. FIG. 3 shows the operation in which the luminance control signal Vc is switched from one level to the other level.

In FIG. 3, as an example of the switching operation, a case where the level of the luminance control signal Vc is changed at time tn and a level (low level) Vd corresponding to a dark state is designated from the level corresponding to the bright state of the EL device is shown. In place of the Vc level so far, the voltage detecting circuit 14 compares the Vd level with the voltage Vcpw after time tn, and detects that the voltage Vcpw has reached the Vd level to set the control signal Vs to the low level. The discharging time T0 of the capacitor Cpw is constant irrespective of the luminance control signal or the like.

Thus, the voltage of the level corresponding to the designated luminance is charged to the capacitor Cpw and the voltage can be discharged from the capacitor Cpw to the EL device 10.

Peculiar operation and effect which are obtained by providing the capacitor Cpw in the present embodiment will now be described further in detail hereinbelow.

Figure 4:
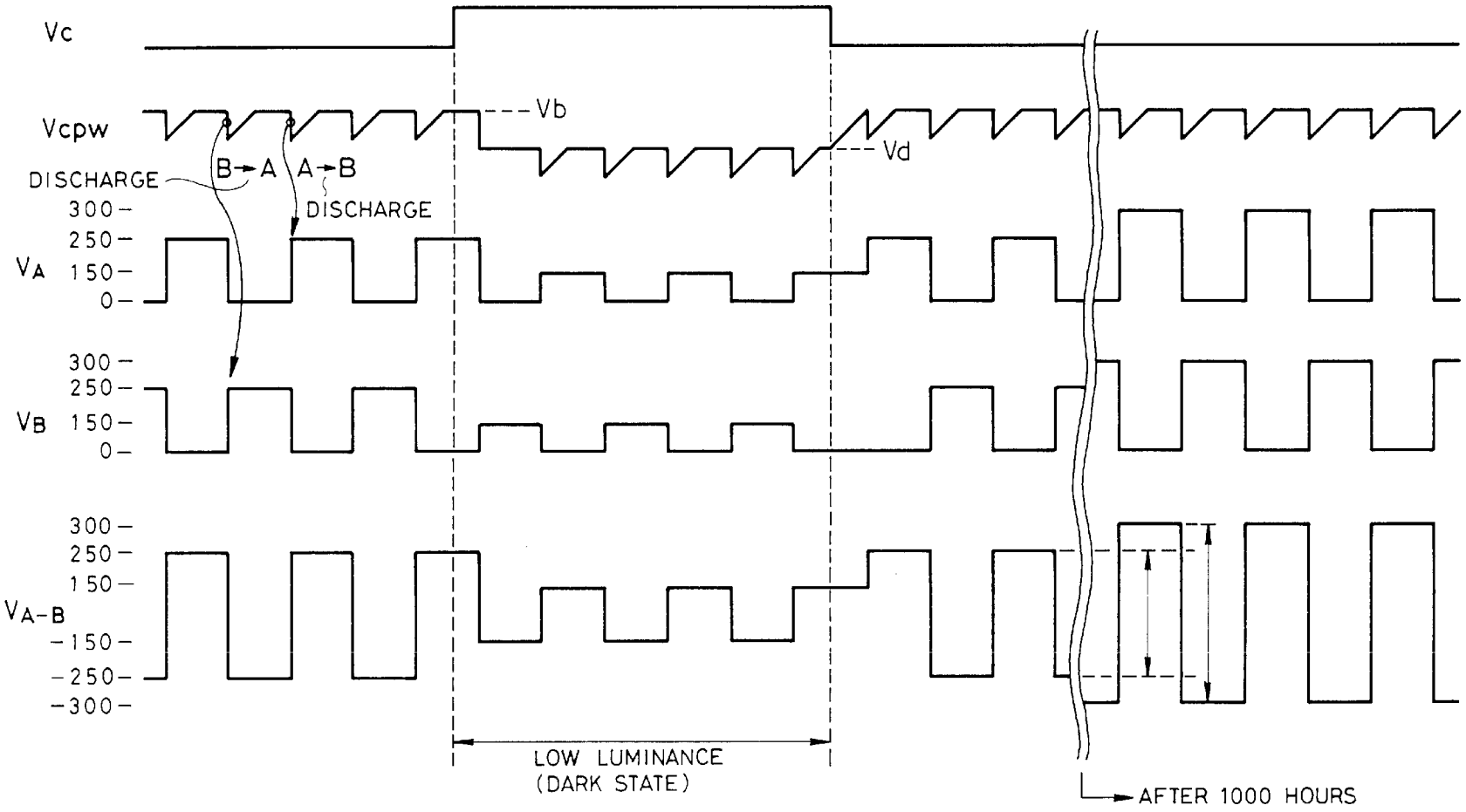
FIG. 4 is a waveform diagram showing a state of an application of voltage at an EL device in the display system of FIG. 1.

In FIG. 4, an electric potential VA of the electrode A of the EL device 10 rises at the discharge timing in the (A→B) direction and falls at the discharge timing in the (B→A) direction, the directions being described above. On the contrary, an electric potential VB of the electrode B of the EL device 10 rises at the discharge timing in the (B→A) direction and falls at the discharge timing in the (A→B) direction, the directions also being described above. The potentials VA and VB, therefore, have the relation (opposite phase relation) in which they change relatively to the opposite polarities. A discharge interval in the (B→A) direction and a discharge interval in the (A→B) direction are equal. The first and second control signals, consequently, correspond to those relations. If each of the potentials VA and VB has a rectangular waveform in which peak-to-peak voltages of them are, for example, 250V respectively when the high luminance of the EL device 10 is designated, a voltage $V_{A-B}$ between the electrodes of the EL device 10 has a rectangular wave in which the maximum value is equal to 250V and the minimum value is equal to −250V, so that a peak-to-peak voltage of the $V_{A-B}$ is 500V. The EL device 10 emits the light having an intensity (luminance) according to the peak-to-peak voltages.

When the luminance control signal Vc is at the high level, that is, when the low luminance or light-off of the EL device 10 is designated, the peak-to-peak voltages decrease. As mentioned above, this is because the voltage at the level corresponding to the designated luminance is charged to the capacitor Cpw and the charged voltage is discharged from the capacitor Cpw.

When seeing the right side of FIG. 4, a state where the EL device 10 is operated for a long time, for example, 1000 hours will be understood. According to the state, the respective peak-to-peak voltages of the potentials VA, VB and the voltage $V_{A-B}$ between the electrodes are larger than those in the beginning.

This is because it is necessary to cope with a situation such that the light emission efficiency (light emission intensity or luminance for the peak-to-peak voltage applied) decreases due to the deterioration or the like of the EL device 10 as compared with that in the beginning. That is, in order to obtain the same light emission intensity as that in the beginning, the driving level of the EL device 10, that is, the peak-to-peak voltage is raised by an amount corresponding to the reduction of the light emission intensity. In the embodiment, the increase in peak-to-peak voltage is not executed by a manual adjustment (for example, an output voltage value of the power source module 12 is changed by an adjustment knob of the module) but is automatically and accurately executed by a construction accompanied with the capacitor Cpw for charging and discharging.

The operation by the construction accompanied with the capacitor Cpw can be described as follows.

Figure 5:
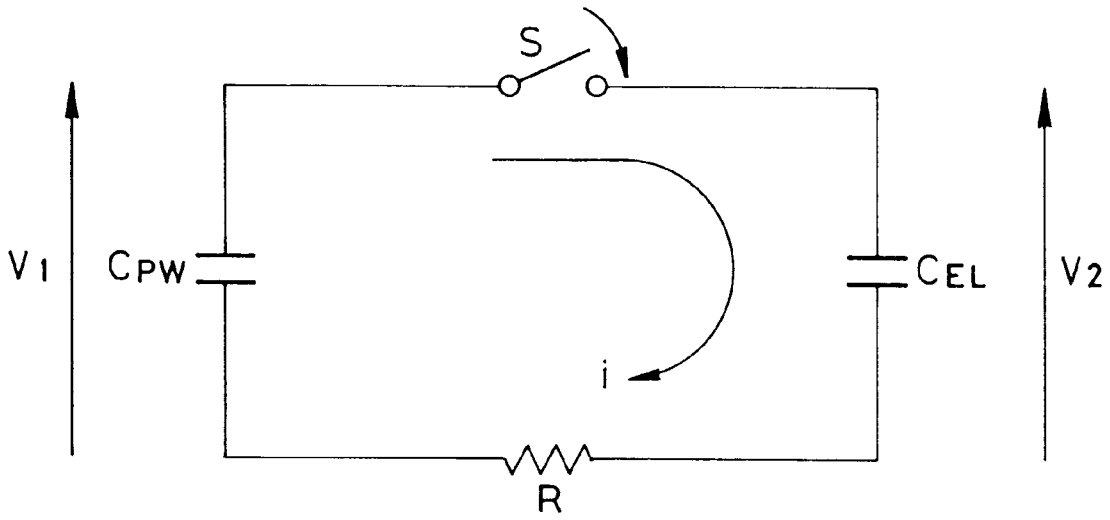
FIG. 5 is an equivalent circuit diagram showing the relation between the EL device and the capacitor Cpw in the display system of FIG. 1.

FIG. 5 is an equivalent circuit diagram showing the relation between the EL device 10 and capacitor Cpw. One end of an equivalent capacitor $C_{EL}$ of the EL device 10 and one end of the capacitor Cpw are connected via a switch S. The other end of the equivalent capacitor $C_{EL}$ and the other end of the capacitor Cpw are connected via a resistor R. When the switch S is closed in a state where the voltage of the capacitor Cpw is equal to V1 and that of the equivalent capacitor $C_{EL}$ is equal to V2, the following equations are satisfied by a principle of invariance of charge amount.

$$i = (V1 - V2)(1/R)\exp(-t/RC) \tag{1}$$

$$C = CpwC_{EL}/(Cpw + C_{EL}) \tag{2}$$

$$V_{CPW} = (CpwV1 + C_{EL}V2)/(Cpw + C_{EL}) + \{(V1 - V2)C_{EL}\}e^{-t/RC}/(Cpw + C_{EL}) \tag{3}$$

$$V_{CEL} = (CpwV1 + C_{EL}V2)/(Cpw + C_{EL}) - \{(V1 - V2)C_{EL}\}e^{-t/RC}/(Cpw + C_{EL}) \tag{4}$$

$V_{CPW}$ and $V_{CEL}$ are voltages in transient states of Cpw and $C_{EL}$ after the switch S was closed and they are in the same direction as V1 and V2.

The closure of the switch S corresponds to a time when the transistor Q1 or Q3 is turned on and the capacitor Cpw is discharged (a predetermined discharging time from times t11 and t21 when referring to FIG. 2). V1 corresponds to a charged voltage of the capacitor Cpw just before discharging.

The discharging operation of the capacitor Cpw and the charging operation of the EL device 10 (equivalent capacitance $C_{EL}$) are executed in accordance with the transient characteristics as shown by the above equations. In short, in the EL device 10, a time constant upon charging is determined by the self capacitance and the capacitance of the capacitor Cpw. In an initial state where there is no deterioration of the EL device 10, the capacitance of the EL device is relatively large and the time constant upon charging is then consequently large. As shown by a solid line $V_{CELO}$ in FIG. 6, the charged voltage of the EL device 10, therefore, draws a gentle charging curve showing a relatively small voltage V0 at a time point after a predetermined charging time T0 (discharging time of the capacitor Cpw) elapsed from the start (t=0) of the charging. When the EL device 10, however, deteriorates after that, the capacitance of the EL device becomes smaller than that at the initial time and the charging time constant then decreases. As shown by an alternate long and short dash line $V_{CELn}$ in FIG. 6, the charged voltage of the EL device 10 draws a steeper charging curve showing Vn larger than the voltage V0 at a time point after the elapse of the charging time T0 that is the same as that at the initial time from the start of the charging.

That is, by providing with the construction of the capacitor Cpw as shown in FIG. 5 to the EL device 10, when the EL device 10 deteriorates, an increase ratio of the charged voltage can be raised, thereby realizing the operation which is equivalent to that a voltage larger than the initial voltage is applied to the EL device 10. At the time point after the elapse of the predetermined time T0, the voltage Vn larger than the initial voltage V0 drives the EL device 10, thereby compensating an amount corresponding to the reduced light emission efficiency and maintaining the same luminance as the initial one.

Figure 6:
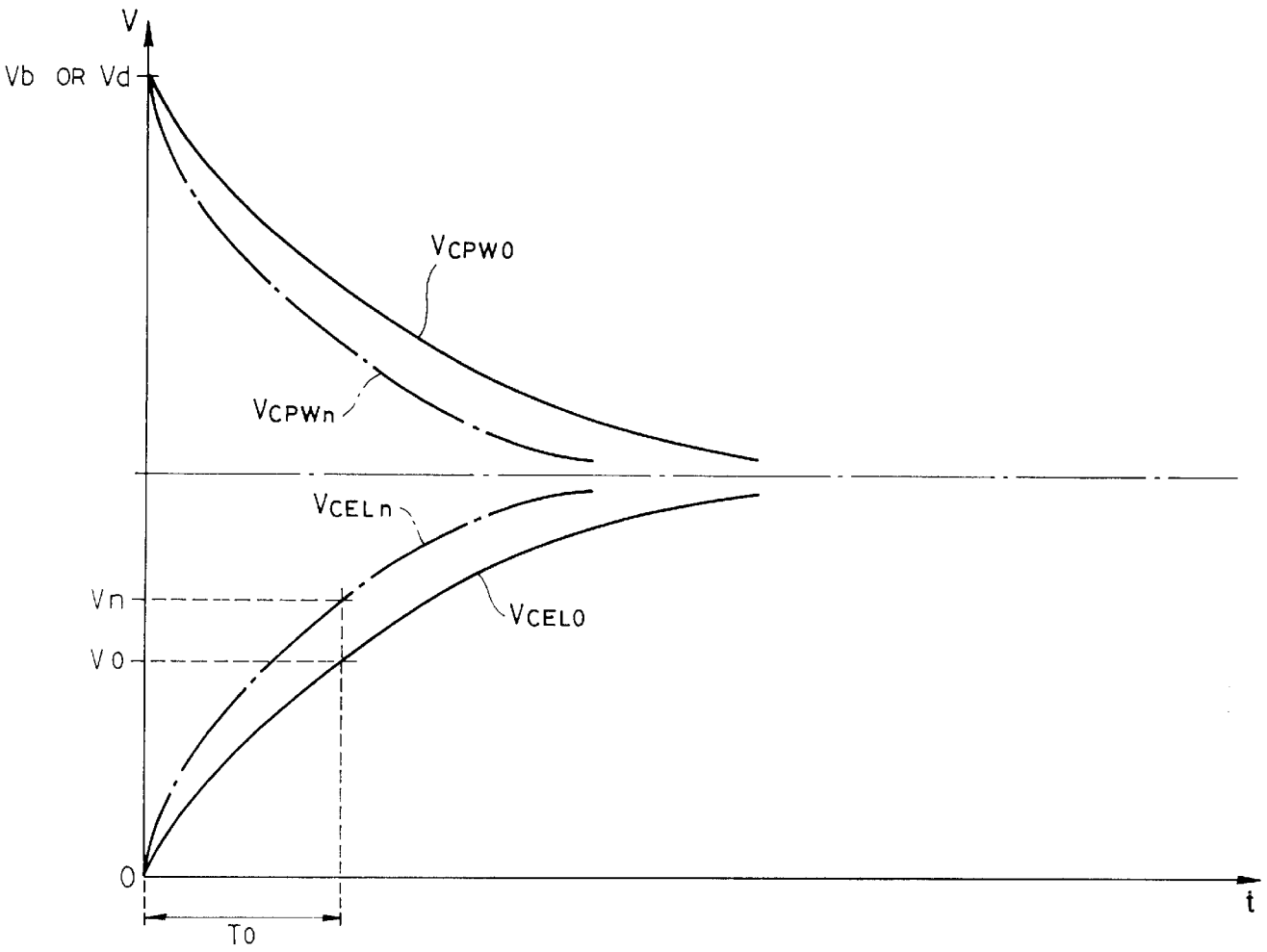
FIG. 6 is a graph showing discharging characteristics of the capacitor Cpw and charging characteristics of the EL device in the display system of FIG. 1.

In order to maintain the same luminance as the initial value, it is necessary to maintain the charging voltage (Vb or Vd) at the same level as the initial level in the capacitor Cpw. There is an opposite relation between the rising of an increase ratio of the charged voltage of the EL device 10 due to the decrease in charging time constant and the rising of a decrease ratio of the discharging voltage of the capacitor Cpw due to the decrease in discharging time constant. In FIG. 6, a solid line $V_{CPWO}$ shows discharging voltage characteristics of the capacitor Cpw at the initial time and an alternate long and short dash line $V_{CPWn}$ shows discharging voltage characteristics of the capacitor Cpw after the deterioration of the EL device. In more detail, in order to give some margin to the discharge from the capacitor Cpw to the EL device 10, it is desirable to make the capacitance of the capacitor Cpw larger than the equivalent capacitance of the EL device 10. It is more preferable that the capacitance of the capacitor Cpw is set to a value which is about twice or three times more than the equivalent capacitance of the EL device 10. In order to more accurately compensate the deterioration of the EL device 10, it is necessary to consider not only the reduction of the equivalent capacitance of the device but also an increase in equivalent resistance.

In the embodiment, the compensation of the deterioration of the EL device 10 is automatically and accurately performed by the construction accompanied with the capacitor Cpw and it is also very simple. The invention, consequently, contributes to the decrease in costs and the improvement of the yield.

Although the display system to perform an illumination of the car stereo set has been described as an example, the present invention may be not limited to the display system but may be also obviously applied to other systems.

Although only the EL device has been described in the embodiment, basically, the invention may be also applied to other capacitive light emitting devices in place of the EL device. As mentioned above, the invention may be not limited to the component elements of the embodiment but may be properly modified in a designing range by a person skilled in the art.

As mentioned above in detail, according to the invention, since the voltage applied to the capacitive light emitting device rises in accordance with the decrease in the equivalent capacitance of the capacitive light emitting device, the decrease in drive efficiency of the capacitive light emitting device for the applied voltage is compensated and it is possible to extremely preferably cope with the deterioration due to the aging change or the like of the capacitive light emitting device.

What is claimed is:

1. An apparatus for illuminating a capacitive light emitting device in accordance with a desired brightness level, comprising:

voltage accumulating means for accumulating a first or second voltage energy level according to the desired brightness level;

voltage detecting means for detecting the accumulated voltage level in the voltage accumulating means; and applying means for discharging the voltage in the voltage accumulating means to the capacitive light emitting device at a predetermined time after the voltage detecting means detects that a voltage energy has reached the desired brightness level.

2. The apparatus for illuminating a capacitive light emitting device according to claim 1, wherein said applying means includes a bidirectional conductive switching means for discharging the voltage in the voltage accumulating means to the capacitive light emitting device in one direction in response to a first control signal and for discharging the voltage in the voltage accumulating means to the capacitive light emitting device in another direction in response to a second control signal, and a control means for alternatively generating the first and second control signals.

3. The apparatus for illuminating a capacitive light emitting device according to claim 2, wherein said voltage accumulating means includes a capacitor.

4. An apparatus for driving a capacitive light emitting device with first and second electrodes so as to cause it to illuminate at a desired brightness level, comprising:

a voltage source producing a d-c voltage;

a capacitor for receiving said d-c voltage and accumulating said voltage so as to generate an electrostatic energy;

voltage detection means for detecting the accumulated voltage level across said capacitor so as to produce a detection signal when the accumulated voltage level reaches a desired voltage level that corresponds to said desired brightness level;

means for keeping the accumulated voltage level at said desired voltage level;

lighting control means for alternatively generating a first and a second control signal after receiving said detection signal; and switch means for preventing a current from flowing across said light emitting device and for allowing a current based on said electrostatic energy to flow across selected ones of said first and second electrodes in one direction in response to said first control signal and in another direction in response to said second control signal.

5. The apparatus according to claim 4, wherein said lighting control means is adapted to alternatively generate said first and second control signals upon a lapse of a predetermined time period after said detection signal is produced.

6. The apparatus according to claim 4, wherein said switch means allows current to flow across selected ones of said first and second electrodes via a bidirectional conductive switch circuit.

7. The apparatus according to claim 6, wherein said bidirectional conductive switch circuit is constructed by an MOS transistor.

8. The apparatus according to claim 7, wherein a period of said first control signal and a period of said second control signal are equal and phases of the signals for allowing current to flow across selected ones of said first and second electrodes are opposite.

9. The apparatus according to claim 4, wherein said capacitor has a capacitance larger than an equivalent capacitance of said capacitive light emitting device.

10. The apparatus according to claim 4, wherein said capacitive light emitting device is an electroluminescence device.

11. The apparatus according to claim 4, wherein said capacitor holds a voltage energy at a first level or a second level corresponding to a light-on instruction.

12. The apparatus according to claim 4, wherein said means for keeping the accumulated voltage level at said desired level allows said capacitor to be charged to a first level or a second level corresponding to the contents of a light-on instruction.

* * * * *